US006364560B1

(12) United States Patent
Lin

(10) Patent No.: US 6,364,560 B1
(45) Date of Patent: Apr. 2, 2002

(54) PIVOT MEMBER FOR AN EVA BOOK

(76) Inventor: Jieh-Liang Lin, No. 59, Alley 52, Lane 39, Lian Tsun Road, Feng Yuan City, Taichung Hsien (TW)

( * ) Notice: Subject to any disclaimer, the term of this patent is extended or adjusted under 35 U.S.C. 154(b) by 0 days.

(21) Appl. No.: 09/888,811

(22) Filed: Jun. 25, 2001

(51) Int. Cl.[7] ..... B42F 13/00

(52) U.S. Cl. ..... 402/79; 402/4; 402/80 R; 402/501; 281/21.1; 281/15.1; 281/38

(58) Field of Search ..... 402/4, 25, 79, 402/80 R, 501, 80 L, 26, 42; 281/15.1, 21.1, 38, 51

(56) References Cited

U.S. PATENT DOCUMENTS 1,027,523 A * 5/1912 Buchan ..... 402/501
1,037,292 A * 9/1912 Morden ..... 402/501
2,286,911 A * 6/1942 Hayes ..... 402/501
5,015,114 A * 5/1991 Miller ..... 402/4

* cited by examiner

*Primary Examiner*—Willmon Fridie, Jr.
(74) *Attorney, Agent, or Firm*—Alan Kamrath; Rider, Bennett, Egan & Arundel, LLP

(57) ABSTRACT

An EVA book comprises a number of leaves and at least one pivot member. Each leaf has an edge and at least one hole adjacent to the edge. A slit extends from the edge into the hole. The pivot member includes a central member and two outer members respectively provided on two sides of the central member, thereby defining two outwardly facing recesses. Each leaf and the pivot member are deformable to allow forcible insertion of the pivot member into the hole until the central member is received in the slit, thereby allowing relative pivotal movement between the pivot member and the leaves. In addition, each leaf and the pivot member are also deformable to allow forcible removal of the pivot member from the hole.

8 Claims, 8 Drawing Sheets

PIVOT MEMBER FOR AN EVA BOOK

BACKGROUND OF THE INVENTION

1. Field of the Invention

The present invention relates to a pivot member for a book and, more particularly, to a pivot member for a book that is made of ethylene vinyl acetate (EVA).

2. Description of the Related Art

Books made of ethylene vinyl acetate (EVA) are popular among children. FIG. 1 of the drawings illustrates a conventional EVA book 1 comprised of a plurality of leaves 3 and a U-shape cover 2 for wrapping and bonding the leaves 3 together. However, the leaves 3 cannot be replaced and the book 1 cannot be spread completely. FIG. 2 illustrates another conventional EVA book 4 comprising a plurality of leaves 5 (only one is illustrated) and a cover plate 7. A number of fastening members 6 are provided to hinge the cover plate 7 and the leaves 5 together, thereby allowing a wider spreading of the leaves 5. However, the leaves 5 are irreplaceable. FIG. 3 illustrates a further conventional EVA book 8 comprised of a plurality of leaves 9 (only one is shown) and a pivot device comprising a main body 11 and a plurality of engaging members 10. Each engaging member 10 is extended through respective aligned holes 92 of the leaves 9 and includes two ends that are retained in place after they pass through an associated hole 12 in the main body 11. Replacement or rearrangement of the leaves 9 is troublesome, as every engaging member 10 must be removed and then remounted after finishing the replacement or rearrangement.

SUMMARY OF THE INVENTION

An object of the present invention is to provide a pivot member for a book that is made of ethylene vinyl acetate (EVA), wherein the leaves of the book can be replaced or rearranged conveniently and wherein the leaves of the book can be spread completely.

A book in accordance with the present invention is preferably made of ethylene vinyl acetate and comprises a plurality of leaves and at least one pivot member. Each leaf has an edge and at least one hole adjacent to the edge. A slit extends from the edge into the hole. The pivot member includes a central member and two outer members respectively provided on two sides of the central member, thereby defining two outwardly facing recesses. Each leaf and the pivot member are deformable to allow forcible insertion of the pivot member into the hole until the central member is received in the slit, thereby allowing relative pivotal movement between the pivot member and the leaves. In addition, each leaf and the pivot member are also deformable to allow forcible removal of the pivot member from the hole.

The slit is defined between two opposing end walls between which the central member of the pivot member pivotally extends. Each outer member includes an annular wall for restraining outward movement of the respective end wall.

The book may further comprise a cover plate having at least one hole structure for pivotally receiving the pivot member. The hole structure comprises a first hole, a second hole, and a neck communicating the first hole with the second hole. The neck has a width slightly larger than a thickness of the central member of the pivot member. Each of the first hole and the second hole has a thickness larger than an overall thickness of the pivot member. An overall length of the hole structure is longer than a maximum diameter of the pivot member.

Thus, the EVA book with pivot members in accordance with the present invention allows easy and convenient replacement and/or rearrangement of the leaves of the book. In addition, the cover plate provides a firm support for the user during use.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
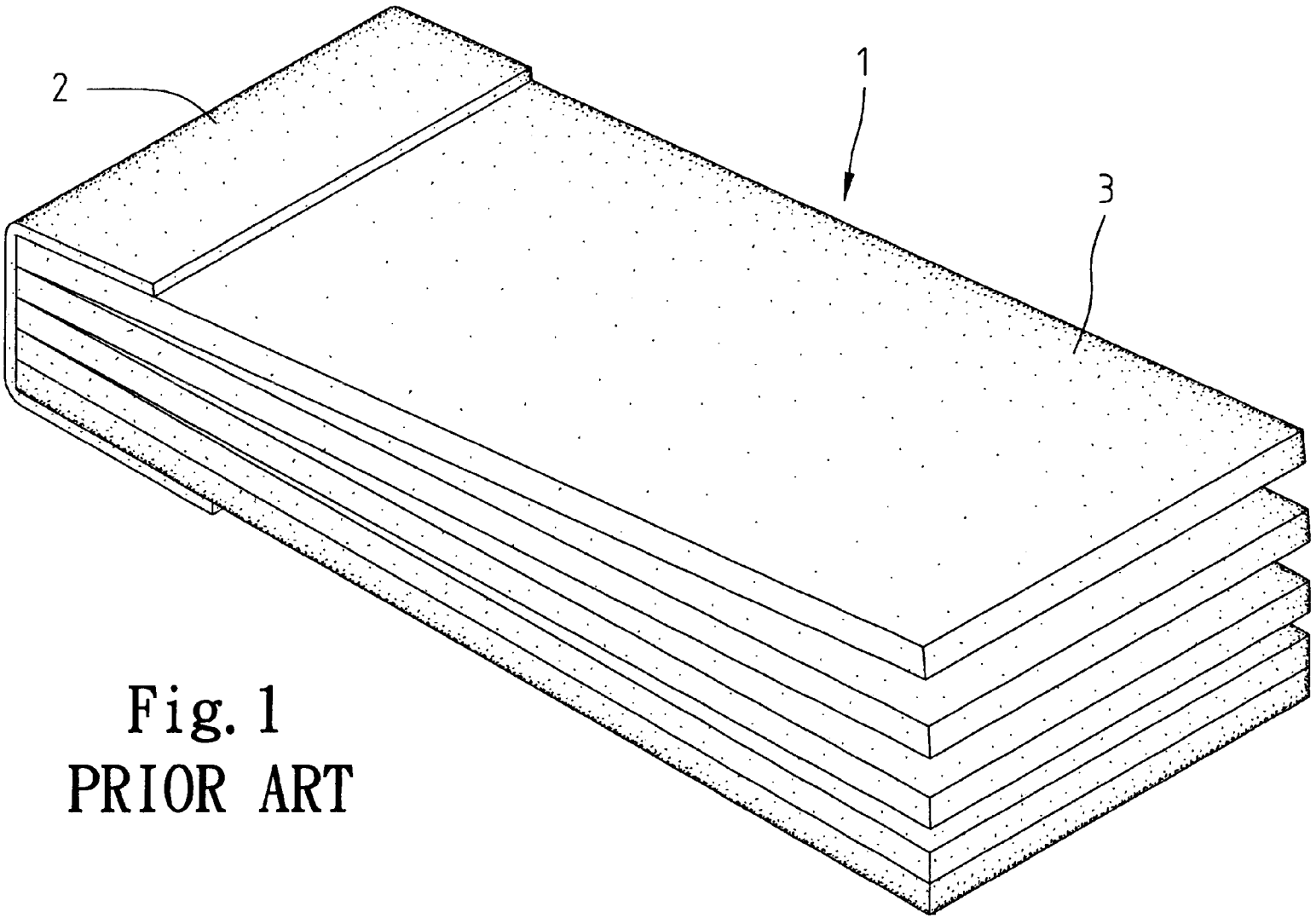
Fig. 1 PRIOR ART
FIG. 1 is a perspective view of a conventional EVA book.
Figure 2:
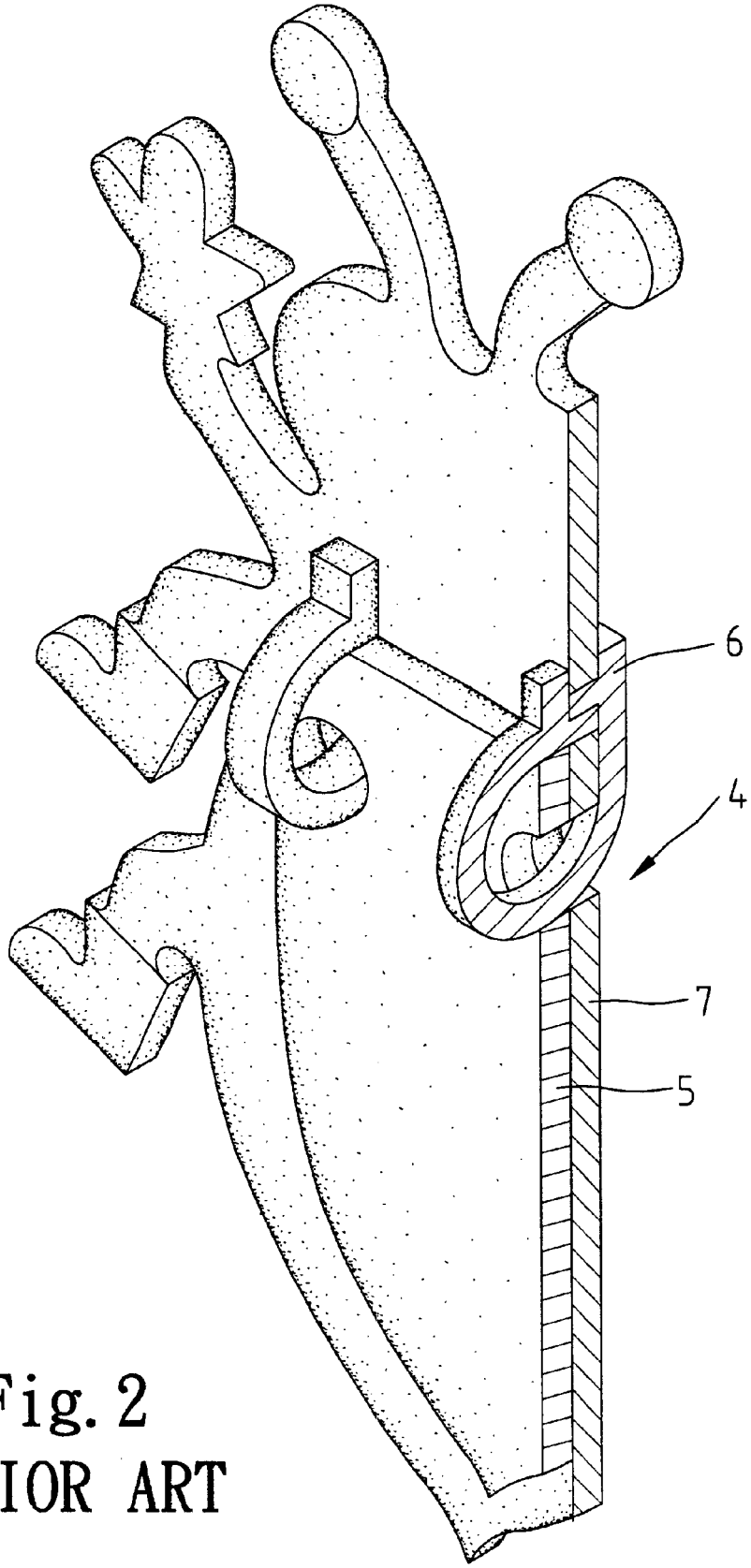
Fig. 2 PRIOR ART
FIG. 2 is a perspective view, partly cutaway, of another conventional EVA book.
Figure 3:
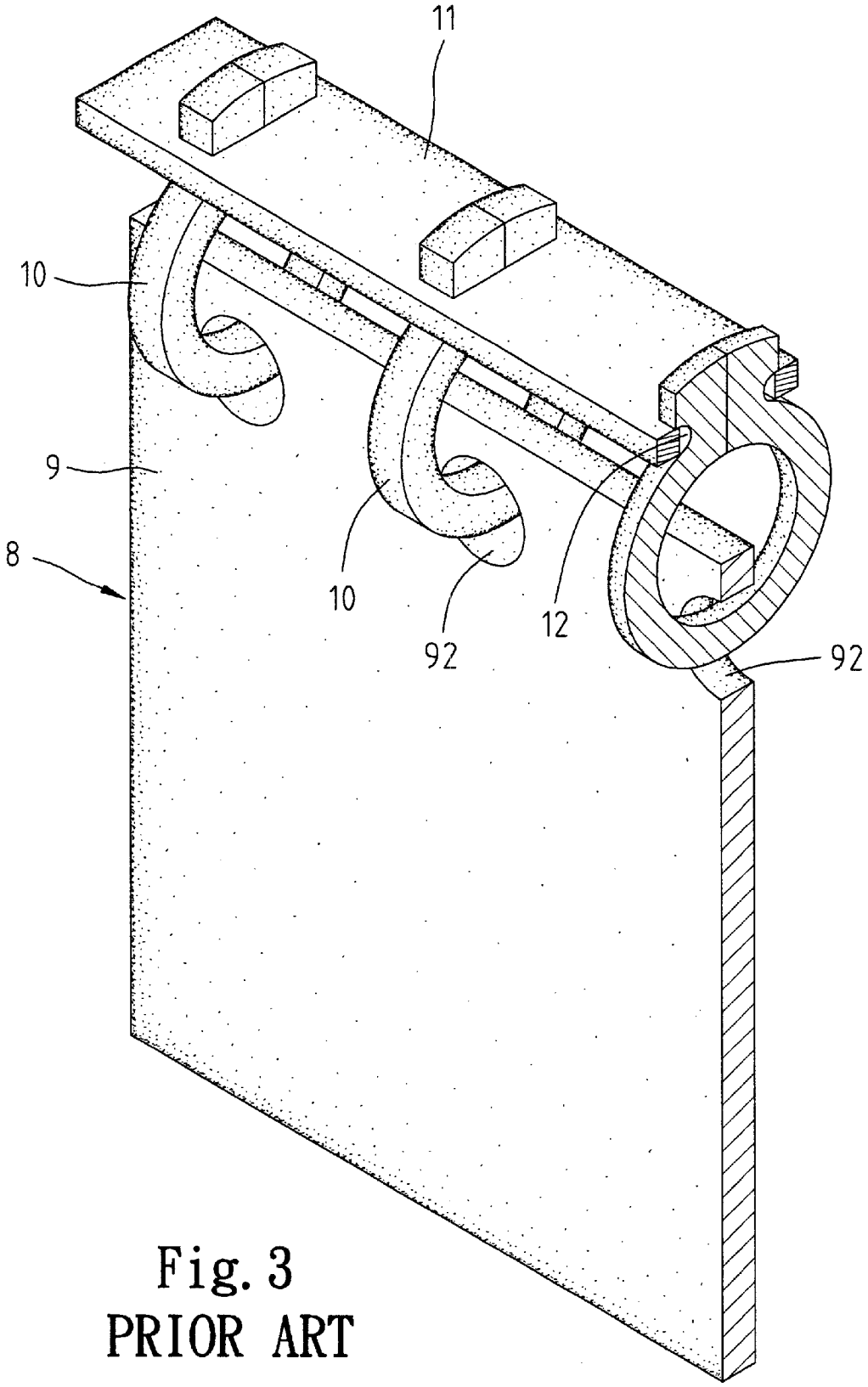
Fig. 3 PRIOR ART
FIG. 3 is a perspective view, partly cutaway, of a further conventional EVA book.
Figure 4:
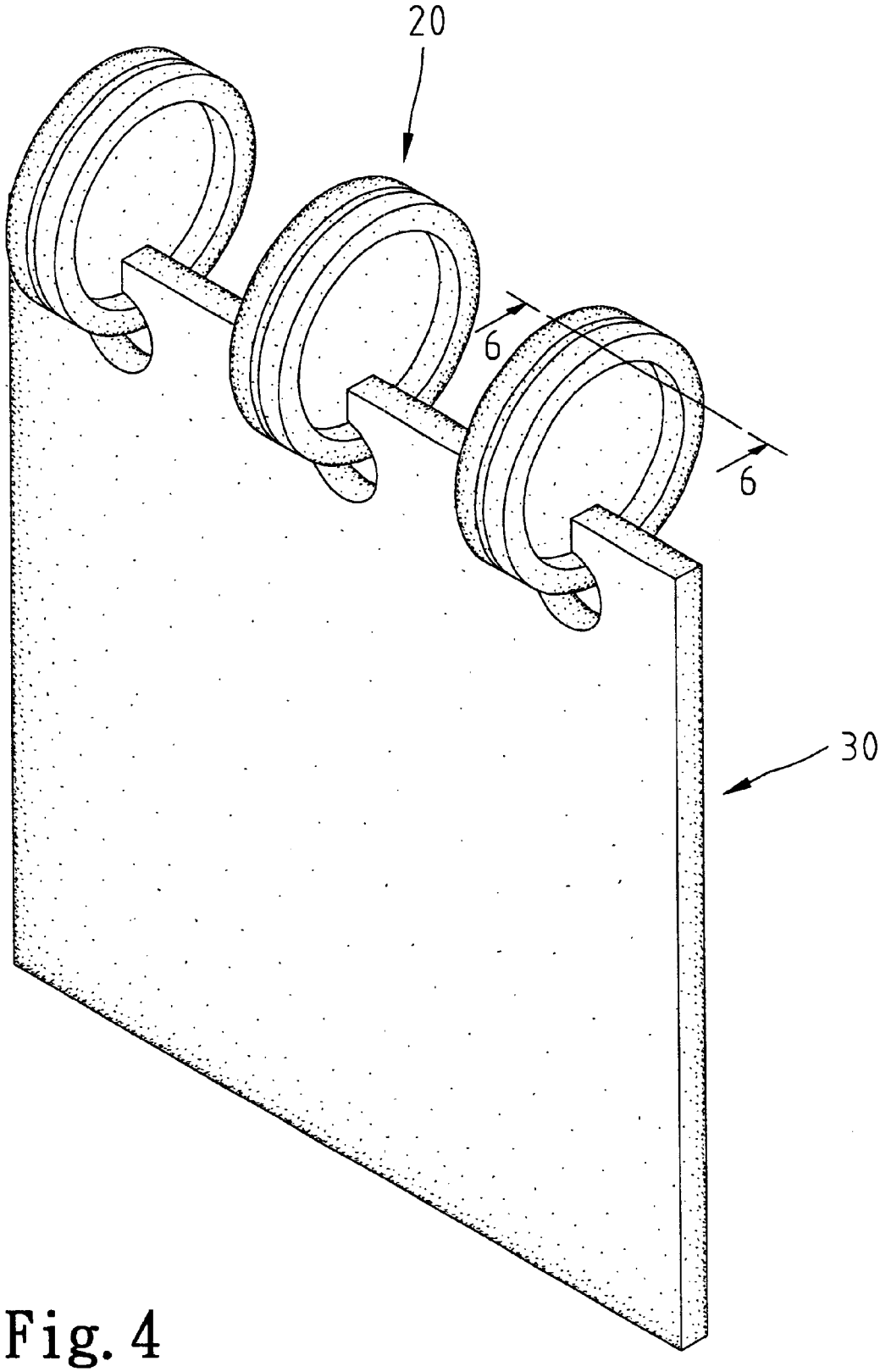
FIG. 4 is a perspective view of an EVA book in accordance with the present invention.
Figure 5:
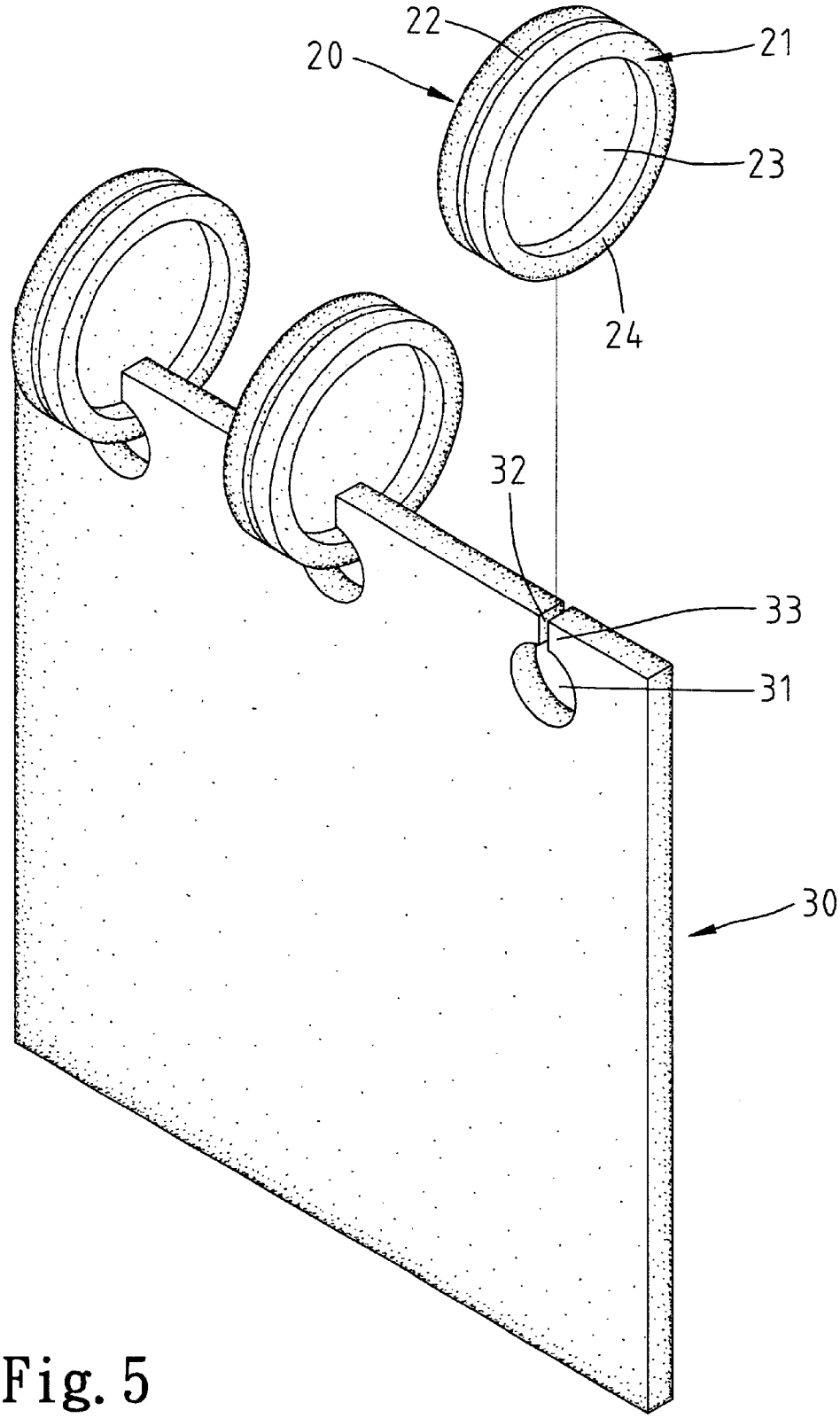
FIG. 5 is a perspective view, partly exploded, of the EVA book in FIG. 4.
Figure 6:
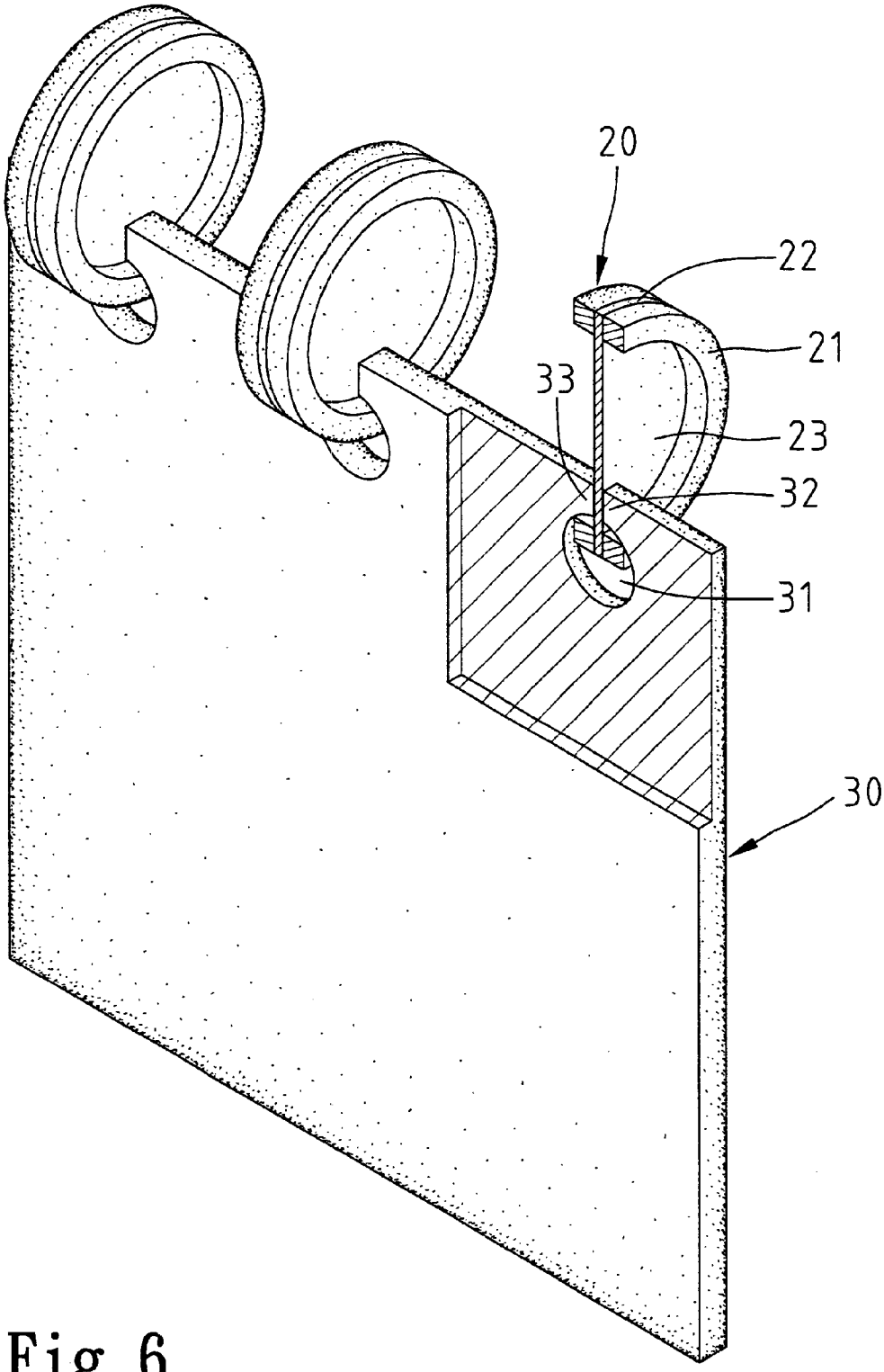
FIG. 6 is a perspective view, partly cutaway along plane 6—6 in FIG. 4, of the EVA book in FIG. 4.

Referring to FIGS. 4 through 6, an ethylene vinyl acetate (EVA) book in accordance with the present invention generally comprises a plurality of leaves 30 (only one is shown) and at least one pivot member 20 for engaging the leaves 30 together yet allowing pivotal movement of the leaves 30. Each leaf 30 includes at least one hole 31 arranged adjacent to an edge thereof. In this embodiment, there are three pivot members 20 and three holes 31. A slit 32 extends from the edge of the respective leaf 30 into the respective hole 31, thereby defining two opposing end walls 33 that delimit the slit 32.

Each pivot member 20 comprises a central member 22 (in the form of a disc in this embodiment) and two outer members 21 (in the form of rings) attached to two sides of the disc 22, respectively, thereby defining two outwardly facing recesses 23. The disc 22 has a thickness slightly smaller than a width of the slit 32. The pivot members 20 and the leaves 30 are made of soft material (such as polyvinyl acetate) and are thus elastomeric; namely, the pivot members 20 and the leaves 30 are deformable to allow each pivot member 20 to be forcibly passed through the slit 32 until the disc 22 is sandwiched between the opposing end walls 33 whereas each end wall 33 is received in a respective recess 23. Thus, each pivot member 20 cannot be disengaged from the leaves 30 unless a relatively large force is applied, as an annular wall 24 of each of the rings 21 abuts against and is thus stopped by the respective end wall 33 when it is intended to remove the pivot member 20 by a small force. Each hole 31 has a diameter larger than the overall thickness of the respective pivot member 20 to thereby allow free pivotal movement of each leaf 30. A user may spread the leaves 30 completely, as the disc 22 has a thickness slightly smaller than a width of the slit 32. In addition, replacement and/or rearrangement of the leaves 30 are allowed without troublesome operation. It is noted that the pivot member 20 can be a one-piece member comprising a central member and two outer members respectively formed on two sides of the central member.

Figure 7:
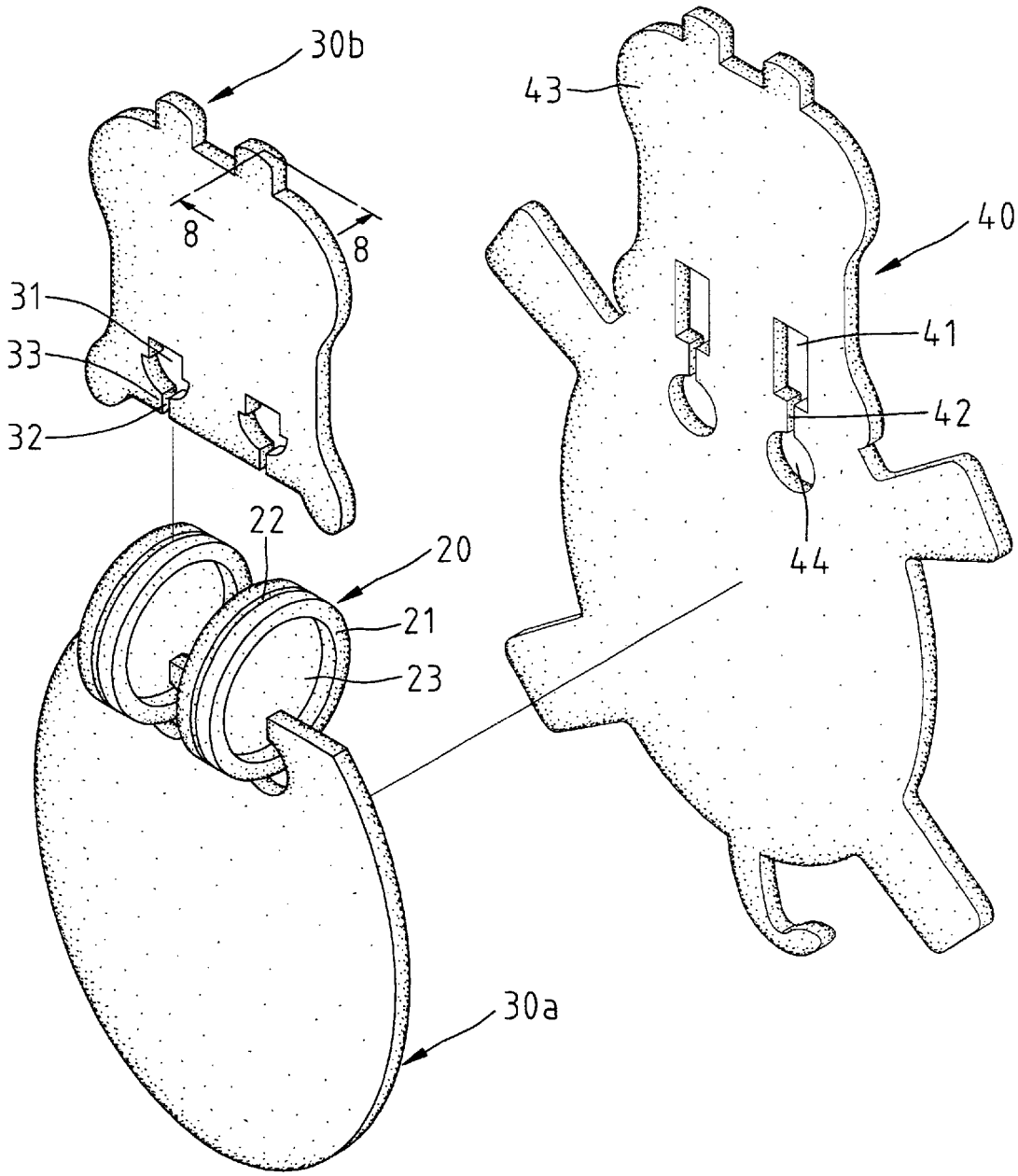
FIG. 7 is a perspective view illustrating another embodiment of the EVA book in accordance with the present invention.
Figure 8:
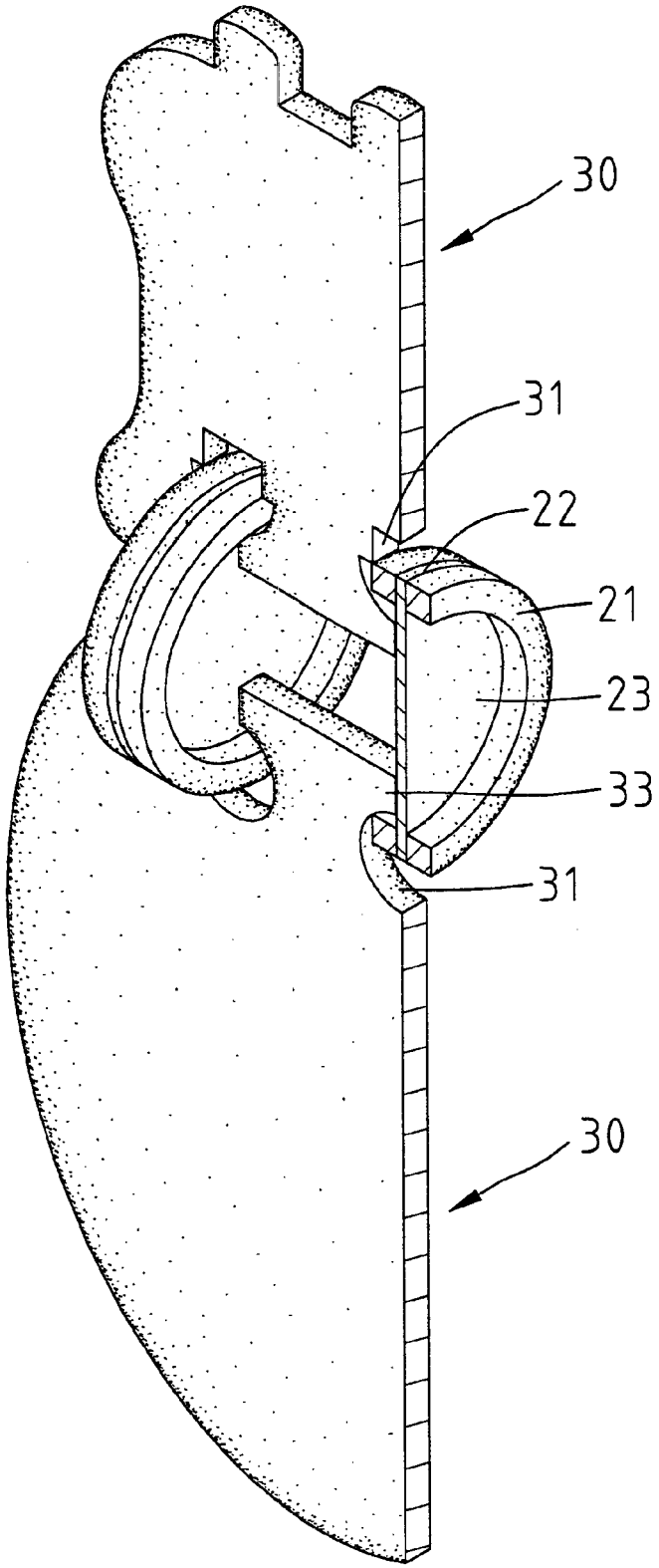
FIG. 8 is a perspective view, partly cutaway along plane 8—8 in FIG. 7, of a portion of the EVA book in FIG. 7.

FIG. 7 illustrates another embodiment of the EVA book in accordance with the present invention. It is noted that the leaves can be of a shape other than rectangles. Namely, leaf 30*a* and leaf 30*b* of different shapes can be used. In addition, the hole 31 of the leaf is not limited to a circle. For example, in the leaf 30*b,* the hole 31 is mushroom-like and communicated with outside via the slit 32, thereby leaving two opposed end walls 33, which is identical to those of the above embodiment. Engagement or removal of the pivot members 20 with or from the leaves 30*a* and 30*b* is identical to that of the above embodiment, best shown in FIG. 8.

Also shown in FIG. 7 is a cover plate 40 that can be attached to an outer side of the book comprising the leaves 30*a* and 30*b*. The cover plate 40 has an area larger than the leaves 30*a* and 30*b* and comprises at least one hole structure. In this embodiment, there are two hole structures each comprising a first hole 44, a second hole 41, and a neck 42 communicating the first hole 44 with the second hole 41. The neck 42 has a width slightly larger than the thickness of the central member 22 of the respective pivot member 20, thereby allowing pivotal movement of the respective pivot member 20. Each of the first hole 44 and the second hole 44 have a thickness larger than the overall thickness of the respective pivot member 20, thereby allowing the leaves 30*a* and 30*b* to pivot freely. In addition, the overall length of the hole structure is longer than a maximum diameter of the respective pivot member 20. The cover plate 40 may support the leaves 30*a* and 30*b* in a completely spread state, which is quite convenient during use.

According to the above description, it is appreciated that the EVA book with pivot members in accordance with the present invention allows easy and convenient replacement and/or rearrangement of the leaves of the book. In addition, the cover plate 40 may provide a firm support for the user during use.

Although the invention has been explained in relation to its preferred embodiment, it is to be understood that many other possible modifications and variations can be made without departing from the scope of the invention as hereinafter claimed.

What is claimed is:

1. A book comprising:

a plurality of leaves each having an edge and at least one hole adjacent to the edge, a slit extending from the edge into said at least one hole;

at least one pivot member including a central member and two outer members respectively provided on two sides of the central member, thereby defining two outwardly facing recesses;

each said leaf and said at least one pivot member being deformable to allow forcible insertion of said at least one pivot member into said at least one hole until the central member is received in the slit, thereby allowing relative pivotal movement between said at least one pivot member and said plurality of leaves;

each said leaf and said at least one pivot member being also deformable to allow forcible removal of said at least one pivot member from said at least one hole.

2. The book as claimed in claim 1, wherein the slit is defined between two opposing end walls between which the central member of said at least one pivot member pivotally extends, each said outer member including an annular wall for restraining outward movement of the respective end wall.

3. The book as claimed in claim 1, further comprising a cover plate having at least one hole structure for pivotally receiving said at least one pivot member.

4. The book as claimed in claim 3, wherein said at least one hole structure comprises a first hole, a second hole, and a neck communicating the first hole with the second hole, the neck having a width slightly larger than a thickness of the central member of said at least one pivot member, each of the first hole and the second hole has a thickness larger than an overall thickness of said at least one pivot member, and an overall length of said at least one hole structure being longer than a maximum diameter of said at least one pivot member.

5. The book as claimed in claim 1, wherein the book is made of ethylene vinyl acetate.

6. The book as claimed in claim 2, further comprising a cover plate having at least one hole structure for pivotally receiving said at least one pivot member.

7. The book as claimed in claim 6, wherein said at least one hole structure comprises a first hole, a second hole, and a neck communicating the first hole with the second hole, the neck having a width slightly larger than a thickness of the central member of said at least one pivot member, each of the first hole and the second hole has a thickness larger than an overall thickness of said at least one pivot member, and an overall length of said at least one hole structure being longer than a maximum diameter of said at least one pivot member.

8. The book as claimed in claim 7, wherein the book is made of ethylene vinyl acetate.

* * * * *